United States Patent [19]

Halsted

[11] 4,097,702

[45] Jun. 27, 1978

[54] CAM ACTUATED SWITCH

[75] Inventor: Edwin H. Halsted, Dayton, Ohio

[73] Assignee: General Motors Corporation, Detroit, Mich.

[21] Appl. No.: 810,091

[22] Filed: Jun. 27, 1977

[51] Int. Cl.[2] ..... H01H 3/34; H01H 50/64

[52] U.S. Cl. ..... 200/153 LB; 200/30 R; 200/38 B; 74/567

[58] Field of Search ..... 200/153 B, 153 E, 153 J, 200/153 LB, 153 L, 282, 283, 153 N, 27 R, 27 A, 27 B, 38 C, 30 R, 38 B; 74/567

[56] References Cited

U.S. PATENT DOCUMENTS

| | | | |
|---|---|---|---|
| 2,939,337 | 6/1960 | Sweger | 200/153 LB |
| 3,424,876 | 1/1969 | Wiser et al. | 200/38 B |
| 3,739,308 | 6/1973 | Paul | 200/153 J |
| 3,748,610 | 7/1973 | Guthart | 200/153 J |

*Primary Examiner*—William Price
*Assistant Examiner*—Joseph M. Moy
*Attorney, Agent, or Firm*—Donald F. Scherer

[57] ABSTRACT

A cam actuated switch permitting rotation in one direction with snap action and in the other direction without snap action. When the cam is rotated in one direction, the switch contacts are opened rapidly by a substantially radial step on the cam surface and a spring arm which presses a cam follower, disposed on another spring arm, against the surface. When the cam is rotated in the other direction, the cam follower is permitted to be displaced axially from the step by the other spring arm and thereby aligned with a ramp which moves both spring arms radially outward to close the switch contacts.

2 Claims, 3 Drawing Figures

CAM ACTUATED SWITCH

This invention relates to cam actuated electric switches and more particularly to reversible rotary snap action switches.

It is an object of this invention to provide an improved rotary switch having a cam actuated switch contact which has snap-action operation in one direction of rotation.

Another object of this invention is to provide an improved rotary switch wherein a cam follower is forced rapidly radially inward past a cam surface by one spring arm carrying an electrical contact when the switch is to be opened and is moved axially by another spring arm and the cam surface when the switch is moved from the open position toward the closed position.

A further object of this invention is to provide an improved cam actuated reversible rotary switch which has a step surface on the cam surface to allow snap-action opening of the switch contacts and a ramp surface on the cam surface to enforce closing and wiping action of the contacts.

These and other objects and advantages of the present invention will be more apparent from the following description and drawings in which.

Figure 1:
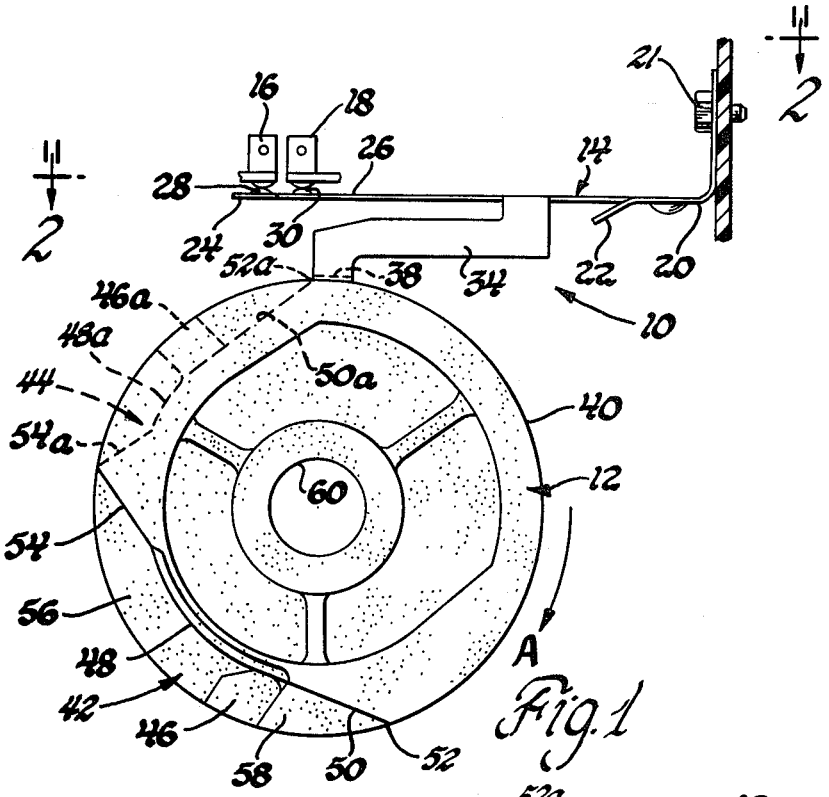
FIG. 1 is an elevational plan view of the switch.
Figure 2:
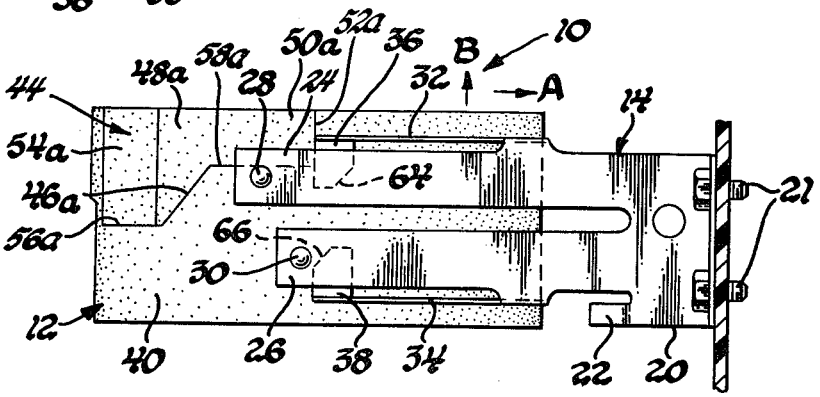
FIG. 2 is a view taken along line 2—2, FIG. 1.

Referring to the drawings, there is shown in FIGS. 1 and 2 a switch assembly 10 having a cam member 12, a bifurcated moveable switch arm 14 and a pair of stationary switch contacts or terminals 16 and 18. As best seen in FIG. 2 the arm 14 has a singular base portion 20 which is adapted to be secured via fasteners 21 to a stationary member. An electrical terminal 22 is formed on the singular base member 20. The switch arm 14 has a pair of contact spring arms 24 and 26 which extend from the base member 20 and have secured thereto electrical switch contacts 28 and 30 adapted to contact the terminals 16 and 18 respectively. The switch contact arm 24 has formed integrally therewith and disposed normally thereto a spring arm 32, the switch spring arm 26 has formed integrally therewith and disposed normally thereto a spring arm 34. Each of the spring arms 32 and 34 have integrally formed therewith cam followers 36 and 38 respectively. The cam followers 36 and 38 are in sliding contact with the external circumferential surface 40 of the cam member 12 and are maintained in this position by the spring force in the arms 24, 26.

The cam member 12 has two cam profiles 42 and 44 formed therein. The cam profiles are substantially identical in nature and design such that the description for one cam profile will suffice, and the corresponding components of the other cam profile will be designated with the same numerical characteristic having an "*a*" suffix. The cam profile 42 has a substantially radial step portion 46 which extends radially inwardly from the circumference 40 to intersect a recessed circumferential portion 48. The recessed circumferential portion is in intersecting relationship with a ramp portion 50 adjacent the step portion 46. The ramp portion 50 intersects the circumference 40 at 52. A second ramp portion 54 intersects both the circumferential portions 40 and 48 at a distance circumferentially displaced from the step 46 and ramp 50. As best seen in cam profile 44 a pair of end wall portions **56*a* and 58*a* extend between the circumferential portion 48*a* and the circumference 40, and between the ramp portion 50*a* and the circumference 40**.

Figure 3:
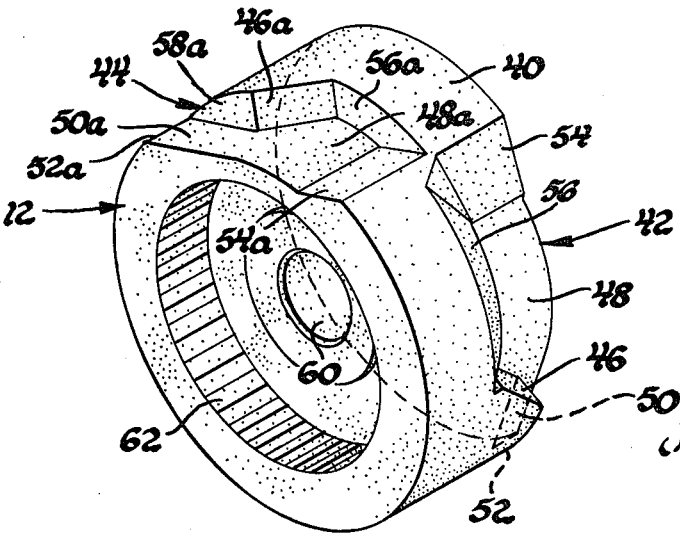
FIG. 3 is a perspective view of the cam portion of the switch.

The cam member 12 has a centrally disposed opening 60 in which may be inserted a shaft, not shown, to support the cam 12 or alternatively provide a rotary input for the cam 12. As seen in FIG. 3 the cam 12 may be provided with and internally toothed diameter 62 which may also be utilized to provide an input drive to the rotary switch if desired. The input drive to the tooth portion 62 can be any of the well known type rotary drives such as high reduction types through the use of a small diameter pinion gear or an orbiting type gear which has slightly less teeth than the gear portion 62. These types of drives and others which are well known in the art may be used to provide the rotary input to the switch 10 depending on the particular nature of the device in which the switch is used.

As can be seen, in the position shown in FIG. 2, the cam follower 36 is aligned with the stepped portion **46*a*. Likewise the cam follower 38 is aligned with the step portion 46. When the cam 12 is rotated in the direction of arrow A, the cam follower 36 will remain in contact with the circumferential surface 40 until the step portion 46*a* is reached. At that time the spring action of arm 24 will cause the follower 36 to move radially inwardly into abutting relationship with the surface 48*a*. The steps 46 and 46*a* are angled to permit the slight rotation of the spring arms 24 and 26 relative to the base 20 caused by their inward movement. During this motion the electrical contact 28 will become disengaged from the contact member 16 thus opening the switch formed by contact 28 and terminal 16. In particular applications, such as antenna actuators, the source causing rotation of the cam 12 will be disconnected from electrical power upon opening of contacts 16 and 28, thereby stopping rotation of the cam 12 with the contacts 16 and 28 in the open position while the contacts 18 and 30 remain in the closed position. The switch is preferably used in a system wherein the reversible type drive is utilized. For example, the switch can be used in a conventional antenna actuator system wherein the up-down actuation of the antenna is signalled by a switch normally located in the radio circuit and a power disconnect switch, such as switch 10 described here, positioned between the power source and the actuator, and wherein the cam 12 is driven by the antenna drive motor at such a rate that upon reaching the fully extended or fully retracted position either switch contacts 16 and 28 or 18 and 30** will be opened to prevent further operation of the motor until the radio control switch is operated again.

Assuming that the switch contacts 16 and 28 are now open and the cam follower 36 is resting on surface **48*a* and further assuming that the drive system for the cam 12 is operated in reverse direction, the following will occur: as the cam 12 begins to rotate in a direction opposite to arrow A the cam follower 36 having a beveled portion 64 will abut the radial surface of cam 46*a* thereby forcing the spring arm 32 to be moved in the direction of arrow B such that the cam follower 36 will be aligned with the ramp 50*a*. The cam follower 36 will of course be maintained in alignment with ramp 50*a* due to the presence of end wall 58*a* until the circumferential surface 40 is reached at which time the spring arm 32 will move in the direction opposite to arrow B and become realigned with the step 46*a*. During the movement of spring arm 32, the spring arm 24 remains aligned vertically with the electrical contact 16 such that, upon the movement of the spring arm 24 towards the top terminal 16, the contact 28 undergoes a wiping action due to upward movement of the spring arm 24 and the bending which is accompanied with the spring force in arm 24. Thus on each closing of the switch contact there is a slight rocking motion of the contact points which maintains the good electrical contact. As the cam 12 continues to rotate in a direction opposite to arrow A the cam follower 38 will eventually come across the step portion 46 such that the cam follower will be forced into contact with the surface 48 through the spring action in arm 26 thus opening the electrical switch provided by contact 30 and terminal 18. At this time the electric motor driving the cam 12** will cease operation in a manner described above.

If the cam 12 is then rotated in the direction of arrow A, the bevel surface 66 on cam follower 38 will abut the radial surface of step 46, thereby moving the spring arm 34 downwardly as seen in FIG. 2, until alignment with ramp 50 is attained at which time the spring arm 26 will be forced upwardly toward the contact terminal 18 until the circumferential surface 40 is reached by the cam follower 38 and at which time the switch contact 30 and terminal 18 are in electrical contact and the cam follower 38 becomes aligned with step 46. If, for some reason, the cam 12 should continue to rotate after the switch contacts are opened and assuming the cam is rotating in the direction of arrow A, the follower 36 will engage the ramp **54*a* which will move the spring arm 24 upwardly as seen in FIG. 1 until the circumferential surface 40 is reached and the electrical contacts will be closed. The cam of course will then continue to operate and until the complete rotary movement had occurred at which time the cam follower 36 would again drop off the step 46*a* and open the switch contacts, this process would of course repeat in either direction of rotation until the motor rotating the cam 12** came to rest.

Obviously many modifications and variations of the present invention are possible in light of the above teaching. It is therefore to be understood, that within the scope of the appended claims the invention may be practiced otherwise than as specifically described.

What is claimed is:

1. A cam actuated reversible switch comprising; a rotatable member adapted to be rotated on an axis in a clockwise and counterclockwise direction having an outer circumferential surface concentric to the axis of rotation; cam means formed on said rotatable member having a substantially radial step portion in a plane oblique to the axis of rotation and a ramp portion, both said oblique step portion and said ramp portion intersecting said outer circumferential surface; and electric contact means having a substantially stationary electrical contact member and a movable electrical contact member having a first spring arm, a second spring arm disposed normal to said first spring arm and a cam follower at the distal end of said second spring arm, said cam follower being maintained in abutment with said rotatable member by said first spring arm, said electrical contact members being maintained in electrical contact when said cam follower is abutting said outer circumferential surface, said electrical contact members being rapidly separated by said first spring arm when said rotatable member is rotated sufficiently in one direction so that said cam follower is permitted to move radially inward by said oblique step portion, said cam follower being maintained in abutment with said oblique step portion by said second spring arm when said rotatable member is rotated in the other direction and said second spring arm and cam follower being moved axially by said oblique step portion to align said cam follower with said ramp portion, said ramp portion forcing said movable contact member radially outward into closing electrical contact with said stationary electrical contact member, said cam follower being moved axially out of alignment with said ramp portion and into alignment with said oblique step portion by said second spring arm when said outer circumferential surface is abutted by said cam follower.

2. A cam actuated reversible switch comprising; a rotatable member adapted to be rotated on an axis in a clockwise and counterclockwise direction having an outer circumferential surface concentric to the axis of rotation; a cam surface formed on said rotatable member having a radial surface extending substantially radially inward from said outer circumferential surface in a plane oblique to the axis of rotation, an arcuate surface concentric with the axis of rotation disposed radially inward from said outer circumferential surface and intersecting said radial surface, a ramp surface extending between said arcuate surface and said outer circumferential surface, and an end wall disposed normal to and intersecting said outer circumferential surface and also intersecting said ramp surface; and electrical switch means having a substantially stationary electrical contact member and a movable electrical contact member having a first spring arm and a second spring arm disposed normal to said first spring arm and having a cam follower maintained in abutment with said rotatable member by said first spring arm, said electrical contact members being maintained in electrical contact when said cam follower is abutting said outer circumferential surface, said electrical contact members being separated by said first spring arm when said rotatable member is rotated sufficiently in one direction and said cam follower is permitted to move radially inward by said radial surface to abut said arcuate surface, said cam follower being maintained in abutment with said radial surface by said second spring arm when said rotatable member is rotated in the other direction and said second spring arm and said cam follower being moved axially by said radial surface to align said cam follower with said ramp surface and being held in abutment therewith by said first spring arm and also being held in abutment with said end wall by said second spring arm, said ramp surface forcing said movable electrical contact member radially outward into closing electrical contact with said stationary electrical contact member, and said cam follower being moved axially out of alignment with said ramp surface by said second spring arm when said outer circumferential surface is abutted by said cam follower.

* * * * *